US008756815B2

(12) United States Patent
Weiland et al.

(10) Patent No.: US 8,756,815 B2
(45) Date of Patent: Jun. 24, 2014

(54) METHODS OF STRUCTURAL HEALTH MONITORING USING METAL BODIES CONTAINING MICROCAVITIES

(75) Inventors: Hasso Weiland, Lower Burrell, PA (US); Markus Heinimann, New Alexandria, PA (US); Robert C. Pahl, W. Lafayette, IN (US); Achim Hofmann, Munich (DE); John Liu, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 13/610,709

(22) Filed: Sep. 11, 2012

(65) Prior Publication Data

US 2013/0000123 A1 Jan. 3, 2013

Related U.S. Application Data

(62) Division of application No. 12/167,605, filed on Jul. 3, 2008, now Pat. No. 8,298,682.

(60) Provisional application No. 60/948,155, filed on Jul. 5, 2007.

(51) Int. Cl.

| | |
|---|---|
| ***B21D 53/88*** | (2006.01) |
| ***B23Q 17/00*** | (2006.01) |
| ***B21C 23/14*** | (2006.01) |

(52) U.S. Cl.

USPC ..... 29/897.2; 29/407.01; 29/407.04; 29/407.05; 29/407.08; 428/586

(58) Field of Classification Search

CPC ..... B21C 23/00; B21C 23/02; B21C 23/14; B62D 65/00; B62D 65/14; B64F 5/009; B23Q 17/20

USPC ..... 29/897.2, 897.3, 897, 407.01, 407.04, 29/407.05, 407.08; 428/586

See application file for complete search history.

(56) References Cited

U.S. PATENT DOCUMENTS

| | | | | |
|---|---|---|---|---|
| 6,322,647 | B1 * | 11/2001 | Kamat et al. | 148/690 |
| 6,630,039 | B2 * | 10/2003 | Lukasak et al. | 148/690 |
| 6,974,633 | B2 * | 12/2005 | Garratt et al. | 428/598 |
| 7,237,418 | B2 * | 7/2007 | Maeno et al. | 72/269 |
| 7,998,402 | B2 * | 8/2011 | Telioui et al. | 420/545 |
| 2006/0118282 | A1 * | 6/2006 | Ren et al. | 165/133 |
| 2008/0117115 | A1 * | 5/2008 | McLean | 343/792.5 |

* cited by examiner

*Primary Examiner* — Sarang Afzali

(74) *Attorney, Agent, or Firm* — Greenberg Traurig, LLP

(57) ABSTRACT

Monolithic metal bodies (e.g., hard aluminum alloys) comprising a continuous microcavity contained within the body are disclosed. The ratio of the cross-sectional area of the metal body to the cross-sectional area of the microcavity may be not greater than 10. The produced metal bodies may be used in structural applications (e.g., aerospace vehicles) to monitor or test the integrity of the metal body.

10 Claims, 13 Drawing Sheets

METHODS OF STRUCTURAL HEALTH MONITORING USING METAL BODIES CONTAINING MICROCAVITIES

CROSS-REFERENCE TO RELATED APPLICATION

This patent application is a divisional of U.S. patent application Ser. No. 12/167,605, filed Jul. 3, 2008, now U.S. Pat. No. 8,298,862, which claims priority to U.S. Provisional Patent Application No. 60/948,155, filed Jul. 5, 2007, and entitled "METAL BODIES CONTAINING MICROCAVITIES AND APPARATUS AND METHODS RELATING THERETO", the contents of each of which are incorporated herein by reference.

BACKGROUND

Monolithic metal bodies can be produced via various methods, such as via various extrusion techniques. During extrusion, a metal billet is solid, but softened in a heating furnace. Extrusion operations typically take place with the billet heated to temperatures in excess of 375° C., and, depending upon the alloy being extruded, as high as 500° C. The extrusion process begins when a ram of an extrusion press applies pressure to the billet within a container of the extrusion press, also known as a direct extrusion process. Alternatively, pressure may be applied to a die assembly that moves against the billet, a process known as indirect extrusion. Hydraulic presses are known to exert pressure in the range of 100 tons to 22,000 US tons. As pressure is initially applied, the billet is pushed against the die, becoming shorter and wider until its expansion is restricted by full contact with the container walls. Then, as the pressure increases, the soft (but still solid) metal billet has no place else to go and begins to squeeze out through the shaped orifice of the die to emerge on the other side as a fully formed profile. The completed extrusion is sheared off at the die and the remainder of the metal is removed to be recycled. After the metal product exits the die, the still-hot extruded metal product may be quenched, mechanically treated, and aged, depending on the alloy.

SUMMARY OF THE DISCLOSURE

Broadly, the present disclose relates to bodies having designed microcavities therein, apparatus for producing the same and methods for producing the same. In one embodiment, the body is a metal body, such as an aluminum body or an aluminum alloy body. In one embodiment, the metal body is a monolithic body. In one embodiment, the metal body is produced from a "hard alloy" aluminum extrusion. A hard aluminum alloy is an alloy which requires relatively high pressures to extrude and whose tensile yield strength in the final temper is generally at least about 50 ksi. Examples of hard aluminum alloys include many 2XXX and 7XXX series alloys and some 6XXX (e.g., high copper or silicon) and 8XXX (e.g., Al—Li) series alloys. Other aluminum alloys may qualify as a hard aluminum alloy.

One or more microcavities may be included in the metal body and may be continuous throughout a portion of the body. In general, the cross-sectional area of the microcavities is smaller than that of the body. In one embodiment, a microcavity has a diameter of not greater than 2 millimeters (on average), such as a diameter of not greater than 1.5 mm (on average), or not greater than about 1 mm (on average). In one embodiment, a microcavity has a diameter of at least about 0.5 mm (on average). In one embodiment, the microcavity has a diameter in the range of from about 0.5 mm to about 2.0 mm (on average). In one embodiment, the microcavity has a diameter of about 1 mm (on average). The microcavity is often of an oval or circular-type cross-section, but may have a cross-section of other geometric shapes (e.g., rectangular).

The microcavities may be useful, for example, in Structural Health Monitoring (SHM). The integrity of an extrusion profile can be sensed with many different SHM technologies along its length, including optical or acousto-ultrasonic methods. Additionally, when one side of the microcavity is plugged, vacuum or gas pressure monitoring technology can be applied. Bodies having microcavities may be utilized in aerospace, commercial transportation (e.g., auto, truck, marine) and civil engineering structures/applications, to name a few. For example, stringers for aerospace applications may be produced with such microcavities. Since the metal bodies may be utilized in structural applications, the ratio of the cross-sectional area of the microcavity ($A_V$) is smaller than that of the cross-sectional area of the metal body ($A_B$). This is contrary to other known metal bodies having large microcavities (e.g., heat exchangers) where increased surface area for heat transfer is useful. In one embodiment, the $A_V/A_B$ ratio is not greater than 10. In one embodiment, the $A_V/A_B$ ratio is not greater than 5. In one embodiment, the $A_V/A_B$ ratio is not greater than 1. In one embodiment, the $A_V/A_B$ ratio is not greater than 0.75. In one embodiment, the $A_V/A_B$ ratio is not greater than 0.5. In one embodiment, the $A_V/A_B$ ratio is not greater than 0.1. The microcavities may be substantially straight. The microcavities may have substantially smooth wall surfaces. The microcavities may be continuous throughout the length of the metal body, and thus the microcavities may extend at least 0.5 meter, or at least 1 meter, or at least 5 meters, or at least 10 meters, or at least 15 meters, or even more. The microcavities may be relatively uniform throughout the length of the metal body. While cylindrical-style microcavities are described herein, other microcavity shapes are possible, and such shapes depend upon the shape of the selected mandrel(s), described below.

The microcavities may be included, for example, in any hard aluminum alloy metal body. In one embodiment, such metal bodies may be utilized in a structural application, where the structure may be monitored/tested via the microcavities. In one embodiment, the metal bodies are used in an aerospace vehicle. In one embodiment, a metal body is a structural component of the aerospace vehicle, such as, for example, a fuselage stringer, a fuselage frame, a wing stringer and the like. In other embodiments, the metal bodies may be for non-aerospace applications, such as automotive, train, marine, oil and gas, and support structures, to name a few. For example, the metal bodies may be included in frame rails or cross members for trucks, trailers, trains, subways, trams, rail cars, and/or other transportation vehicles. The metal bodies may be used in ship hull reinforcements, ship decks and/or superstructures. The metal bodies may be used in oil and gas risers, drill strings and/or platform structures. The metal bodies may be used in bridge decks and/or other transportation infrastructures. The metal bodies may be used in turbine blades. The metal bodies may be used in drive shafts for vehicles or other suitable applications. In short, the metal bodies may be used in any structural application that could benefit from monitoring/testing of the integrity of the metal body, and without substantial degradation of the strength, toughness, fatigue life, or other relevant material property of the metal body.

Dies for producing the microcavities are also disclosed. The dies may be used in a direct or indirect extrusion process. In one approach, a die includes a tortuous passageway disposed within the die, the tortuous passageway comprising an entrance zone for receiving a metal feedstock, an exit zone for discharging a metal product, and a middle zone disposed between the entrance zone and the exit zone. In this approach, the die may include a mandrel fixedly interconnected to the die, where a first portion of the mandrel is disposed within the middle zone of the passageway. In one embodiment, the first portion of the mandrel extends at least one-third of the length of the middle zone. In one embodiment, the mandrel extends at least one-half the length of the middle zone. In one embodiment, the mandrel is absent from the exit zone. Thus, during extrusion of the metal, the metal may flow through the passageway of the die and pass around at least the first portion of the mandrel. As the metal moves away from the mandrel and into the exit zone, an annular space within the metal may be created. Concomitant to the moving of the metal, the metal cools, thereby fixing the annular space and defining the continuous microcavity. By locating the first portion of the mandrel in the middle zone, but having the mandrel absent from the exit zone, the large extrusion forces produced during a direct or indirect extrusion process, which are more pronounced in the longitudinal direction proximal the exit zone of the die, may not significantly affect the mandrel (e.g., severe it, rip it off), thereby allowing the continuous microcavities to be formed in the metal body. Moreover, the pressure on the flowing metal material may be maintained at levels that enhance the rejoining of the metal, thus producing the metal bodies having continuous microcavities.

The mandrel (sometimes referred to as a filament) may be any material adapted/suited to resist metal extrusion conditions. In one embodiment, the mandrel may be integral with the die. For example, the mandrel may be integral with a first plate (e.g., a bridge plate) of a die. In one embodiment, the first plate includes at least one porthole, such as several paired portholes. In the paired porthole approach, each porthole may be separated from its neighbor by a web. In one embodiment, the web is machined to produce the mandrel.

In another embodiment, the mandrel may be non-integral with the die (a separate component). For example, the web may include one or more complementary feature(s) (e.g., female threads) to receive and engage one or more complementary feature(s) of a mandrel (e.g., male threads). In this embodiment, the mandrel may be a removable mandrel that can be readily engaged with and disengaged from the bridge plate of the mandrel. In another example, the die may include a cassette fixedly interconnected with the mandrel, and the die may include a slot for receiving the cassette. In one embodiment, the slot includes an aperture in communication with the middle zone and the cassette, and the aperture is adapted to receive the mandrel. In one embodiment, the aperture is sized to restrictively engage the outer surface of the mandrel. In one embodiment, the die includes a die cap and a supply element interconnected to the die cap where, as interconnected, the die cap and supply element define at least a portion of a tortuous passageway. The tortuous passageway is utilized to create the extended metal body in a suitable configuration. In one embodiment, the supply element includes the slot, and the die further includes a sealing element adapted to interconnect with a proximal end of the supply element to seal the cassette within the die.

The mandrel may be rigid or flexible. In one embodiment, the mandrel is composed of the same material as that of the die (e.g., the same material as the bridge plate), in another embodiment, the mandrel is composed of a different material than that of the die. For example, the mandrel may be in the form of a wire or screw and may comprises a high-strength material, such as, for instance, steel, titanium or a ceramic.

The mandrel may be oriented in a manner that is coincidental to the direction of extrusion, and which may be similar to the center axis of the die. In one embodiment, the axis of a first portion of the mandrel is coincidental to the center axis of the die. In one embodiment, the axis of a first portion of the mandrel is substantially parallel to the center axis of the die.

As noted, the cross-sectional area of the microcavity is generally much smaller than the cross-sectional area of the body surrounding the microcavity. Thus, in one embodiment, the exit zone of the passageway includes a die exit, and the ratio of the cross-sectional area of the first portion of the mandrel to the cross-sectional area of the die exit is not greater than about 1. In one embodiment, this ratio is not greater than 0.5, and in some embodiments this ratio is not greater than 0.1.

The die may include a plurality of mandrels so as to produce a corresponding number of plurality of microcavities in the metal body. In one embodiment, the die includes a first mandrel (as described above) and a second mandrel. The second mandrel may be fixedly interconnected with the die, where a first portion of the second mandrel is disposed within a portion of the middle zone of the die. The first and second mandrels may be of similar or dissimilar lengths. In one embodiment, the length of the first portion of the first mandrel is about equal to the length of the first portion of the second mandrel. In the case of a bridge die, one mandrel per pair of portholes may be utilized. Many different die types may be used, such as, for instance, a porthole die.

Methods for producing metal bodies having continuous microcavities are also disclosed. In one approach, a method includes flowing a metal through a passageway (e.g., of a die) comprising an entrance zone, an exit zone, and a middle zone disposed between the entrance zone and the exit zone, forming the metal into a body proximal the exit zone, and producing, concomitant to the forming step, a continuous microcavity within the body, where the continuous microcavity comprises a diameter of not greater than about 2 mm, and where the ratio of the diameter of the microcavity to the cross-sectional area of the metal body surrounding the microcavity is less than 1.

In one embodiment, the method includes passing a portion of the metal around at least a portion of a mandrel disposed within the middle zone of the passageway. In one embodiment, the producing step comprises passing the metal around at least a portion of a mandrel disposed within the middle zone of the passageway and moving the metal away from the mandrel and into the exit zone, thereby creating an annular space within the metal. In a related embodiment, the method may include the step of cooling the metal concomitant to the moving the metal step, thereby fixing the annular space, where, after the flowing step, the annular space defines the continuous microcavity.

DETAILED DISCLOSURE

Reference is now made to the accompanying figures, which at least assist in illustrating various pertinent features of the present disclosure. Referring now to FIGS. 1A-1H, embodiments of metal bodies having at least one continuous microcavity are illustrated. The metal bodies are made from hard aluminum alloys (e.g., any of a 2XXX, 6XXX, 7XXX or 8XXX series aluminum alloy) and have a continuous microcavity. The continuous microcavities have a cross-sectional area ($A_V$) that is smaller than the cross-sectional area of the surrounding metal body ($A_B$).

Figure 1A:
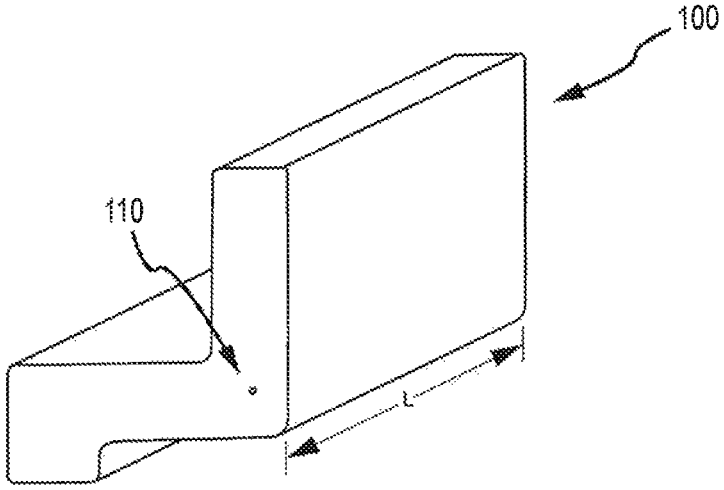
FIG. 1A is a perspective view of a metal body having a continuous microcavity.
Figure 1B:
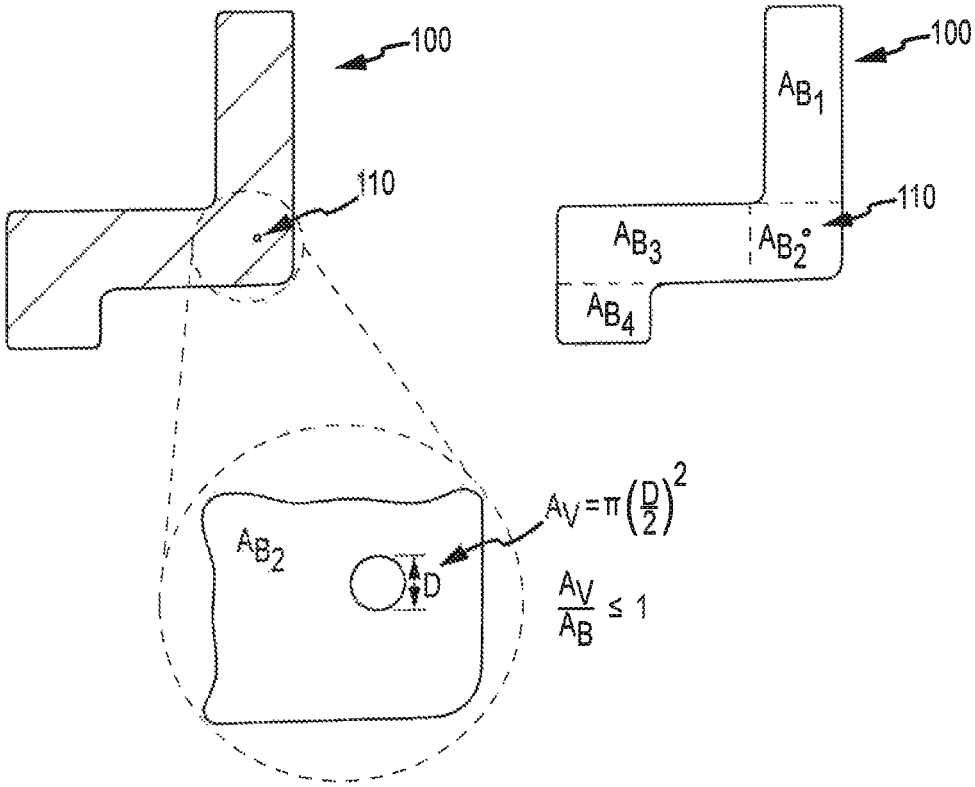
FIG. 1B is a cross-sectional view of the metal body of FIG. 1A.

For example, and with reference to FIGS. 1A and 1B, a metal body 100 made of Aluminum Association alloy 6060 and having a Z-shaped profile is illustrated. The metal body 100 has a continuous microcavity 110. The continuous microcavity 110 extends the length L of the metal body 100. The continuous microcavity 110 is generally straight and has smooth wall surfaces. The continuous microcavity 110 has a cross-sectional area ($A_V$) equal to $\pi$ $(D/2)^2$, where D is the diameter of the microcavity. The metal body 100 generally has several sections ($A_{B_1}$, $A_{B_2}$, $A_{B_3}$, and $A_{B_4}$), which make up the surrounding metal body area $A_B$. The metal body area ($A_B$) has larger cross-sectional area than the microcavity 110. To determine the cross-sectional area of $A_B$, conventional measurement and/or mathematical analysis may be utilized. In the example of FIG. 1A-1B:

$$A_V=\pi(D/2)^2; \tag{1}$$

$$A_B=A_{B_1}+A_{B_2}+A_{B_3}+A_{B_4}A_V; \text{ and} \tag{2}$$

$$A_V/A_B\leq 1 \tag{3}$$

Figure 1C:
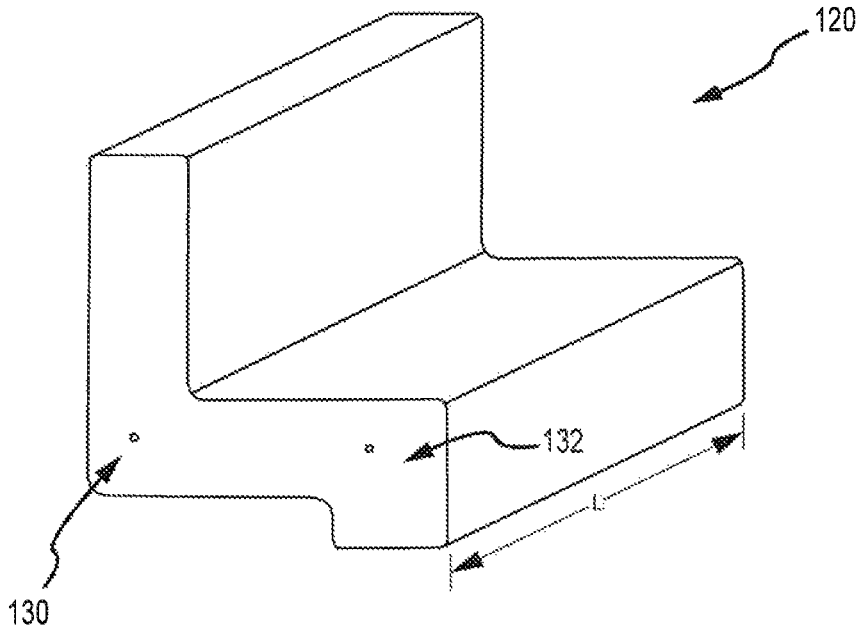
FIG. 1C is a perspective view of a metal body having two continuous microcavities.
Figure 1D:
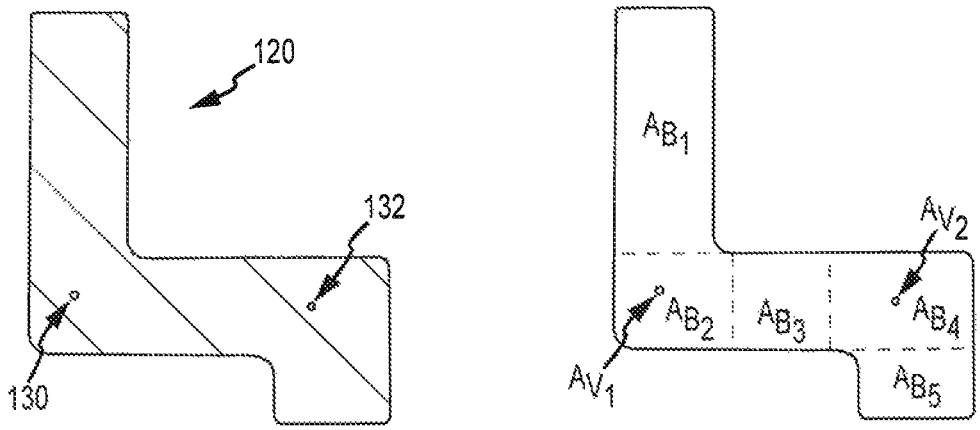
FIG. 1D is a cross-sectional view of the metal body of FIG. 1C.

In another example, and with reference to FIGS. 1C and 1D, a metal body 120 made of Aluminum Association alloy 2099 and having a Z-shaped profile is illustrated. The metal body 120 has two continuous microcavities 130, 132. The continuous microcavities 130, 132 extend the length L of the metal body 120. Each of the continuous microcavities 130, 132 has a cross-sectional area ($A_{V_1}$, $A_{V_2}$) equal to $\pi$ $(D/2)^2$, where D is the diameter of each microcavity. The metal body 120 generally has several sections ($A_{B_1}$, $A_{B_2}$, $A_{B_3}$, $A_{B_4}$ and $A_{B_5}$) which make up the surrounding metal body area $A_B$. In the example of FIG. 1C-1D:

$$A_{V_1}=\pi(D1/2)^2; \tag{4}$$

$$A_{V_2}=\pi(D2/2)^2; \tag{5}$$

$$A_V=A_{V_1}+A_{V_2} \tag{6}$$

$$A_B=A_{V_1}+A_{B_2}+A_{B_3}+A_{B_4}+A_{B_5}-A_{V_1}-A_{B_2} \tag{7}$$

$$A_V/A_B\leq 10 \tag{8}$$

Figure 1E:
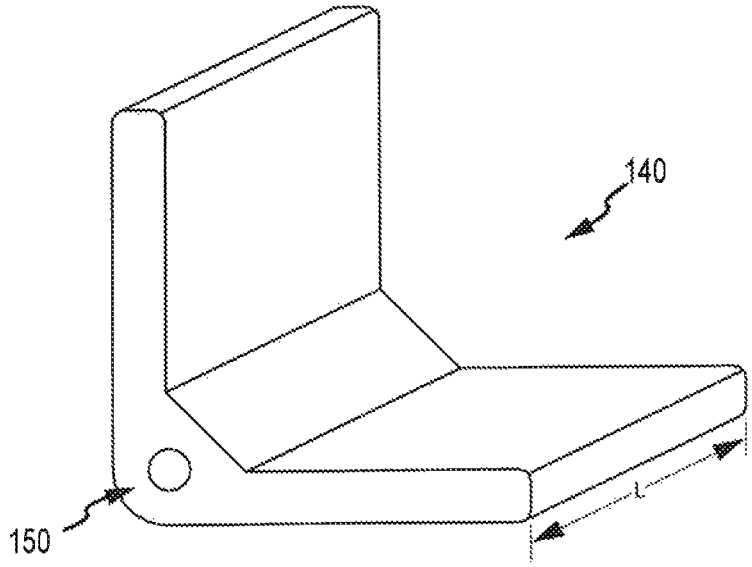
FIG. 1E is a perspective view of a metal body having a continuous microcavity.
Figure 1F:
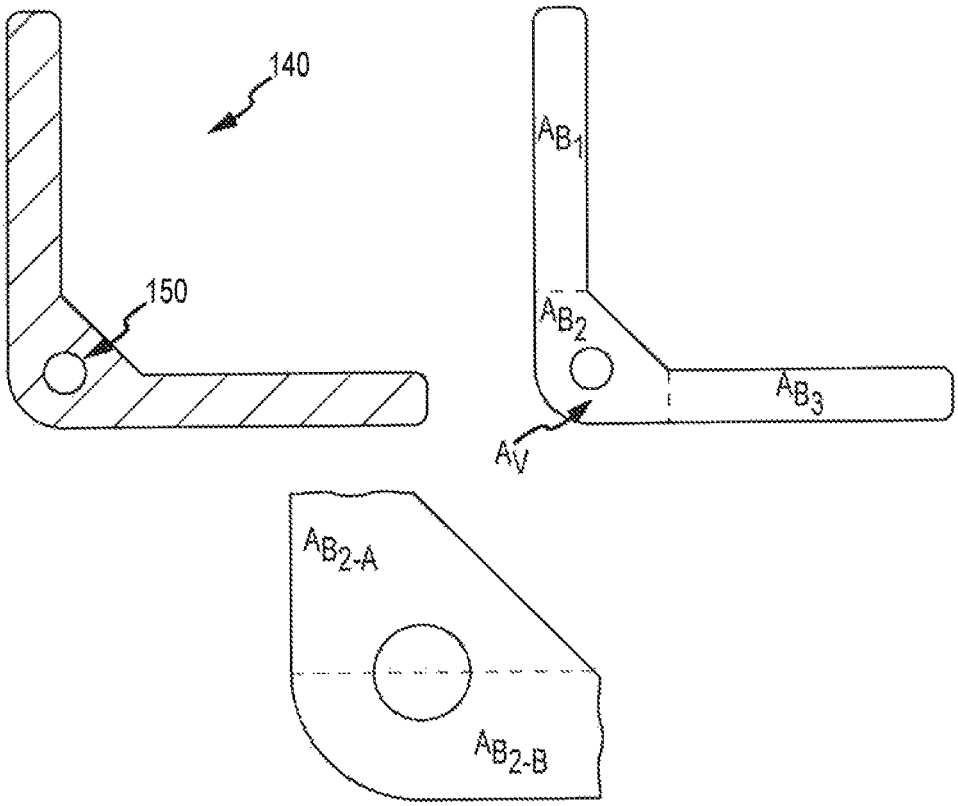
FIG. 1F is a cross-sectional view of the metal body of FIG. 1E.

In another example, and with reference to FIGS. 1E and 1F, a metal body 140 made of Aluminum Association alloy 2099 and having an L-shaped profile is illustrated. The metal body 140 has a continuous microcavity 150. The continuous microcavity 150 extends the length L of the metal body 140. The continuous cavity 150 has cross-sectional area ($A_V$) equal to $\pi$ $(D/2)^2$, where D is the diameter of the microcavity 150. The metal body 140 generally has several sections ($A_{B_1}$, $A_{B_2}$, and $A_{B_3}$), which make up the surrounding metal body area $A_B$. To determine the cross-sectional area of $A_B$, conventional measurement and/or mathematical analysis may be utilized. For example, $A_{B_2}$ may be divided into smaller sections (e.g., $A_{B_{2\text{-}A}}$ and $A_{B_{2\text{-}B}}$), and the amount of the microcavity contained within each section (X, Y) may be subtracted from the area of each section. In this example, X=Y=½, so $A_{B_2}=(A_{B_{2\text{-}A}}-\frac{1}{2}A_V)+(A_{B_{2\text{-}B}}-\frac{1}{2}A_V)$. In the example of FIG. 1E-1F:

$$A_V=\pi(D/2)^2; \tag{9}$$

$$A_B=A_{B_1}+(A_{B_{2\text{-}A}}-\tfrac{1}{2}A_V)+(A_{B_{2\text{-}B}}-\tfrac{1}{2}A_V)+A_{B_3} \tag{10}$$

$$A_V/A_B\leq 1 \tag{11}$$

Figure 1G:
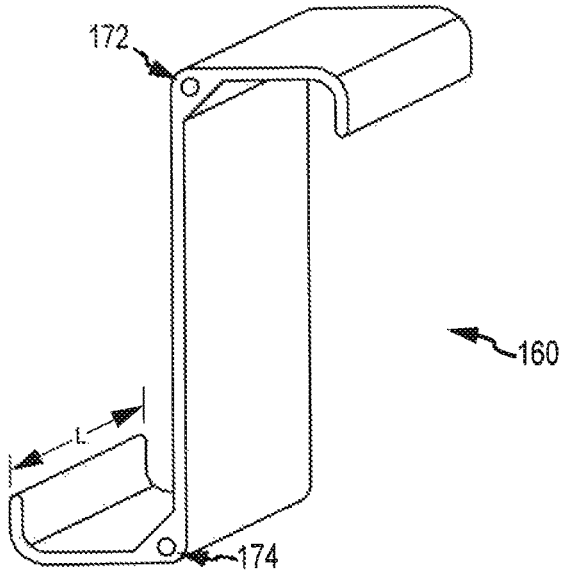
FIG. 1G is a perspective view of a metal body having two continuous microcavities.
Figure 1H:
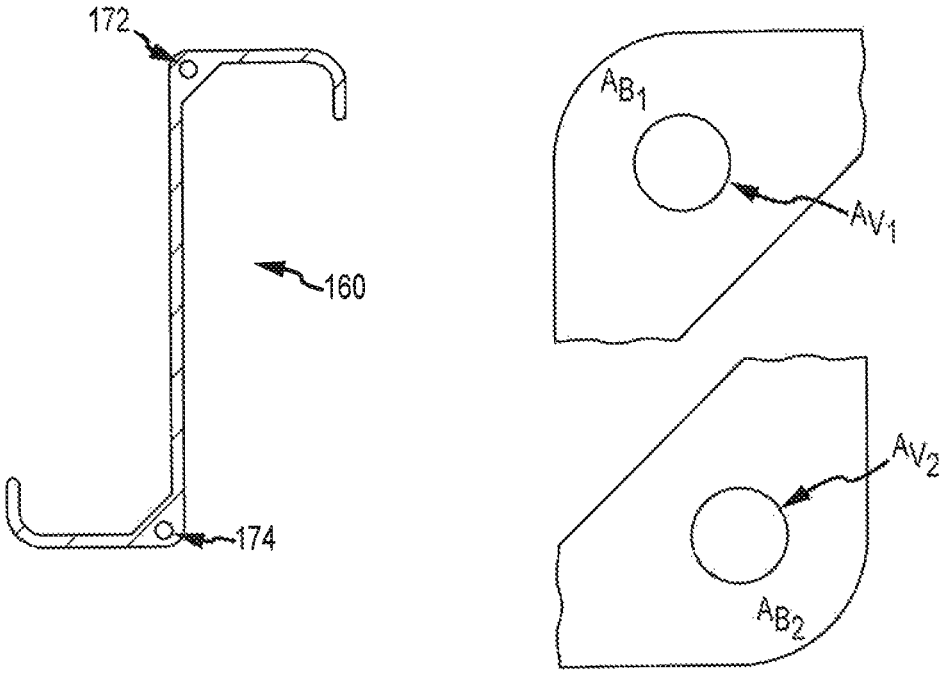
FIG. 1H is a cross-sectional view of the metal body of FIG. 1G.

In another example, and with reference to FIGS. 1G and 1H, a metal body 160 made of Aluminum Association alloy 2099 and having a Z-shaped profile is illustrated. The metal body 160 has two continuous microcavities 172, 174. The continuous microcavities 172, 174 extend the length L of the metal body 160. Each of the continuous microcavities 172, 174 has a cross-sectional area ($A_{V_1}$, $A_{V_2}$) equal to $\pi$ $(D/2)^2$, where D is the diameter of each microcavity. As described above, the metal body 160 generally has several sections, $A_{B_1}$, $A_{B_2}$, and $A_{B_{remainder}}$ (not illustrated), and conventional measurement and/or mathematical analysis may be utilized to determine the cross-sectional area of $A_B$. In the example of FIG. 1G-1H:

$$A_{V_1}=\pi(D1/2)^2; \tag{12}$$

$$A_{V_2}=\pi(D2/2)^2; \tag{13}$$

$$A_V=A_{V_1}+A_{V_2} \tag{14}$$

$$A_B=(A_{B_1}-A_{V_1})+(A_{B_2}-A_{V_2})+A_{B_{remainder}} \tag{15}$$

$$A_V/A_B\leq 1 \tag{16}$$

As illustrated in the above examples, the ratio of the cross-sectional area of the microcavity ($A_V$) is smaller than that of the cross-sectional area of the surrounding metal body ($A_B$), and generally an $A_V/A_B$ ratio is generally not greater than 1. The exact value of $A_V$ and $A_B$ may be determined on a case-by-case basis and may be determined via measurements and/or various mathematical formulas. The metal bodies may be produced in any shape capable of being extruded. The continuous microcavities may also be produced in any shape capable of forming a continuous annular space within the metal body during extrusion. The microcavities may be used, for instance, to check the structural integrity of the metal body in which they are contained. Any number of microcavities may be included in a metal body. However, since the extrusions may be used as a structural component, (e.g., of an aerospace vehicle), a smaller number of microcavities may be preferred.

Metal bodies containing continuous microcavities may be manufactured via direct or indirect extrusion processes. One embodiment of a die useful in a direct or indirect extrusion apparatus and for producing the metal bodies of the instant disclosure is illustrated in FIGS. 2-7. In the illustrated embodiment of FIG. 2, a die assembly 200 includes a sealing element 210, a supply element 220 and a die cap 230. The sealing element 210, supply element 220, and die cap 230 may be fixedly interconnected to one another via locking elements 240, locking element holes 243 (FIG. 6) and related structures (e.g., centering pins 241 (FIG. 6) and related centering pin holes 242). To produce the microcavities, a corresponding number of mandrel(s) 222 extend from the distal end (not numbered) of the supply element 220 toward a distal end 234 of the die cap 230.

Figure 4:
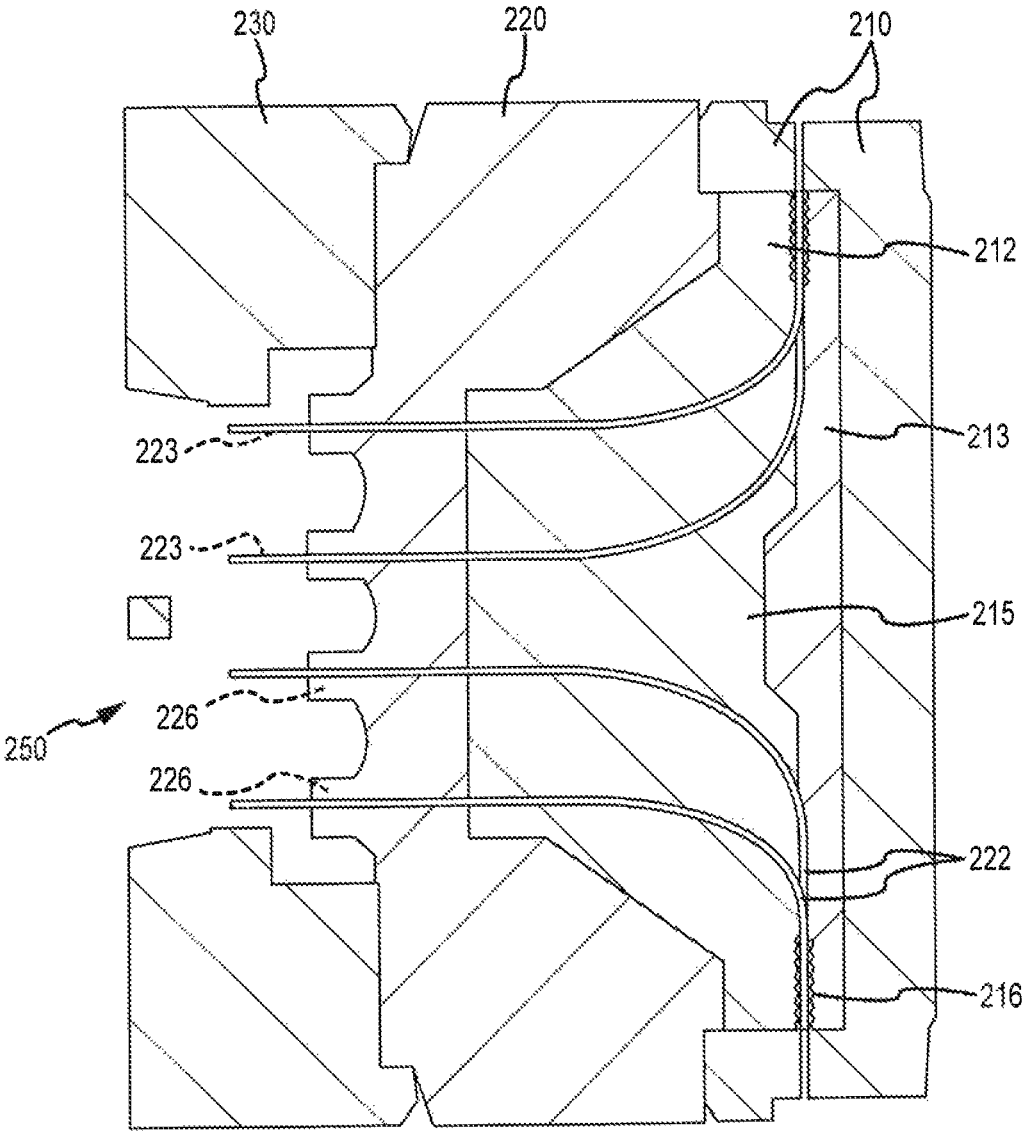
FIG. 4 is a cross-section of the die of FIGS. 2-3 taken along line 4-4.
Figure 5:
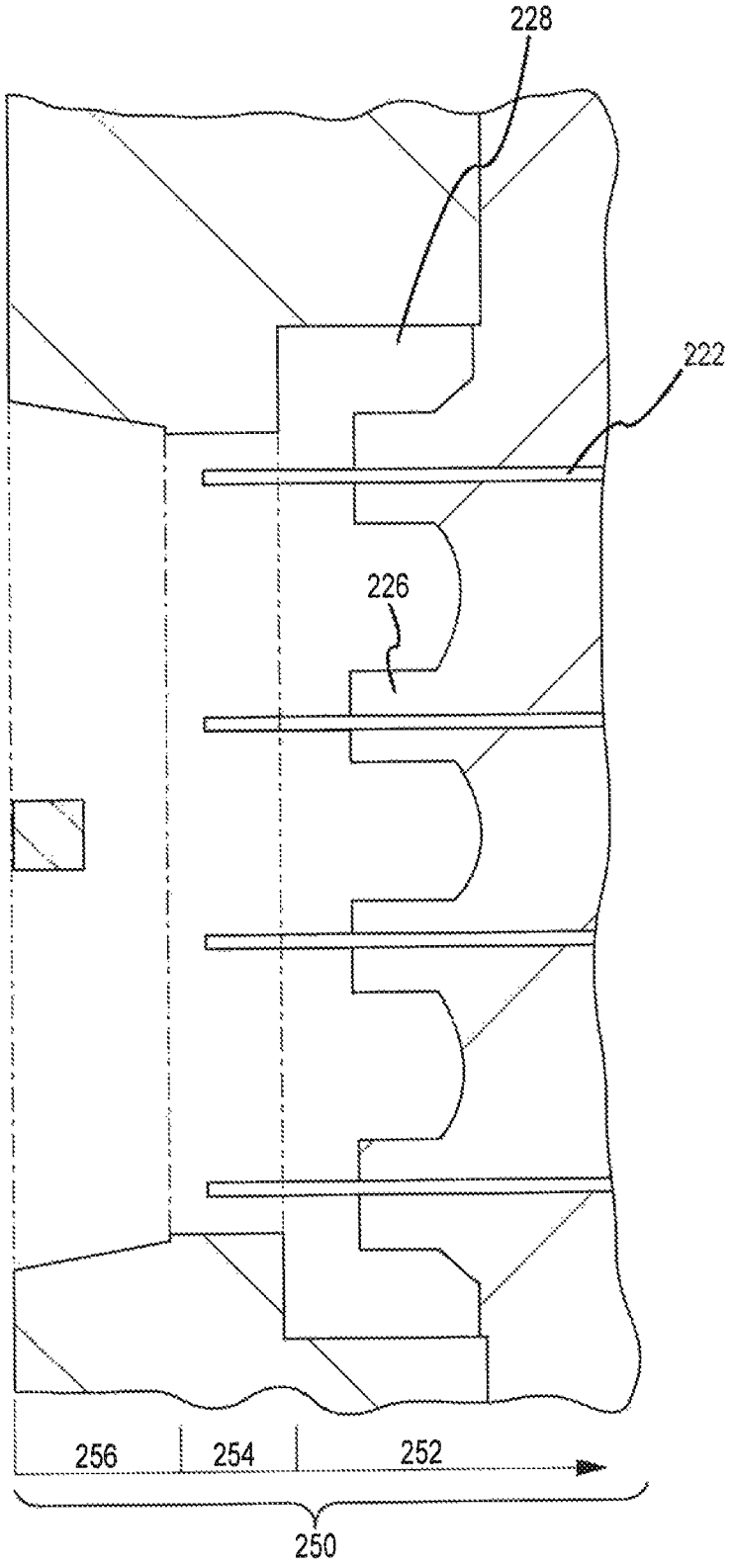
FIG. 5 is a close-up of the cross-section of FIG. 4.
Figure 6:
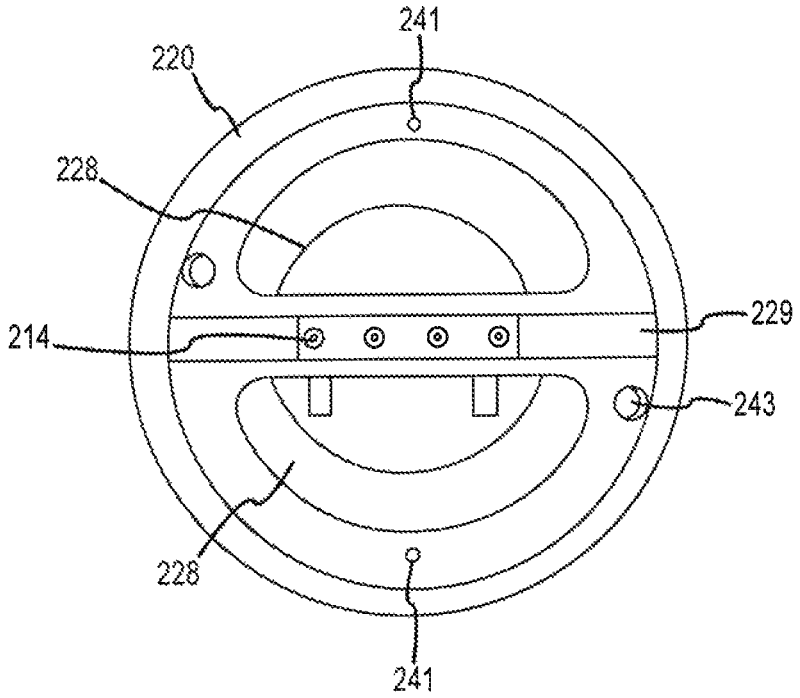
FIG. 6 is a front view of a supply element of the die of FIG. 2.

With particular reference to FIGS. 4 and 5, the mandrel(s) 222 may extend from a cassette 212 of the sealing element 210, through the supply element 220 (e.g., via apertures 214, as illustrated in FIG. 6), and into a welding zone 250 of the die assembly. The mandrel(s) 222 may be held in place via the cassette 212 of the sealing element 210. In particular, the cassette 212 may include a cassette tray 213, a cassette plate 215 and teeth 216 for fixedly mounting the mandrel(s) 222. One or more mandrel holders 226 may be included with the supply element 220 to assist in fixing the mandrel(s) 222 in the desired orientation and/or assist in production of the microcavities.

The distance the mandrel(s) 222 extend into the welding zone 250 may be determinative of whether the microcavities are successfully produced. In one embodiment, the welding zone 250 includes an entrance zone 252, a middle zone 254, and an exit zone 256. In the illustrated embodiment, a first portion 223 of the mandrel(s) 222 extends through the entrance zone 252 and at least partially into the middle zone 254 of the welding zone 250. In one embodiment, the first portion 223 of the mandrel(s) 222 extends at least one-third of the length of the middle zone 254. In one embodiment, the first portion 223 of the mandrel(s) 222 extends at least one-half the length of the middle zone 254. In the illustrated embodiment, the mandrel(s) 222 are absent from the exit zone 256. In some embodiments, the mandrel(s) 222 may extend into the exit zone 256. In some embodiments, the mandrel(s) 222 may extend through, and even out of the exit zone 256. In other embodiments, the mandrel(s) 222 may only extend into the entrance zone 252. The important thing is that the mandrel (s) extend far enough in the welding zone to produce the microcavities, but not so far as to be damaged and/or removed from the die due to the large forces imparted on the mandrel (s) and metal during extrusion. In one embodiment, the axis of the first portion 223 of the mandrel(s) 222 is coincidental to the center axis of the die assembly 200. In a particular embodiment, the axis of the first portion 223 of the mandrel(s) 222 is substantially parallel to the center axis of the die assembly, as illustrated in FIG. 4. As illustrated, the axis of first portions 223 of each of the mandrel(s) 222 are generally aligned with respect to one another. In other embodiments, the axis of a first portion of one mandrel may be transverse to the axis of a first portion of another mandrel.

As metal is extruded through the die assembly 200, metal may flow through a tortuous passageway of the die assembly (e.g., a passageway at least partially defined by supply ports 228 of the supply element 220 and the bores 232 (FIG. 3) of the die cap) and around and in contact with a portion of the mandrel(s) 222. As metal flows out of the die assembly 200 via the die cap 230, each of the mandrel(s) 222 and/or mandrel holders 226 at least partially assists in creating an annular space within the metal by not allowing metal in those portions to fill those regions occupied by the mandrel(s) 222 and/or mandrel holder 226. As the metal cools and exits the die assembly 200, microcavities may be formed from the annular spaces that were produced from the mandrel(s) 222 and/or mandrel holders 226.

The mandrel(s) 222 may be produced from/made of any material adapted to resist metal extrusion conditions. In one embodiment, the mandrel(s) 222 are flexible. In another embodiment, the mandrel(s) 222 are rigid. In one embodiment, the mandrel(s) 222 may comprises a high-strength spring steel wire. In some embodiments, the mandrel(s) 222 are substantially cylindrical in shape, and thus produce similarly shaped microcavities. In other embodiments, the mandrel(s) 222 may be other shapes, such as rectangular solids, or any other geometrical shape so as to produce the microcavities with the desired shape. The mandrel(s) 222 may be non-integral with the die, as illustrated above. In other embodiments, and as described in further detail below, the one or more mandrels may be an integral component of a portion of the die.

Figure 2:
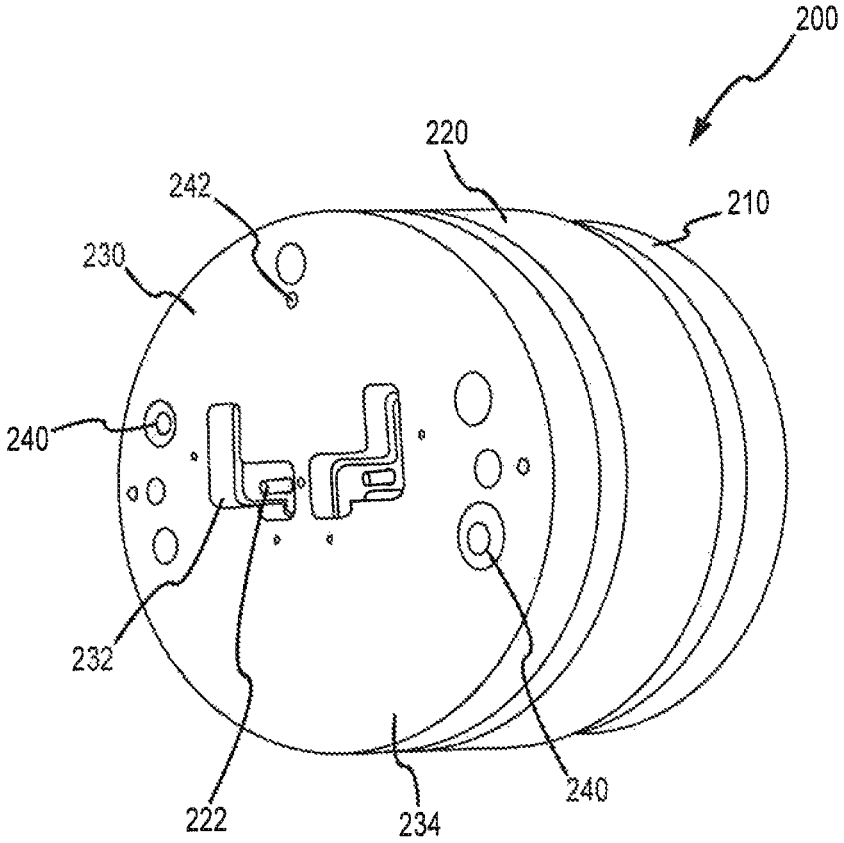
FIG. 2 is a perspective view illustrating one embodiment of a die useful in producing metal bodies having continuous microcavities.
Figure 3:
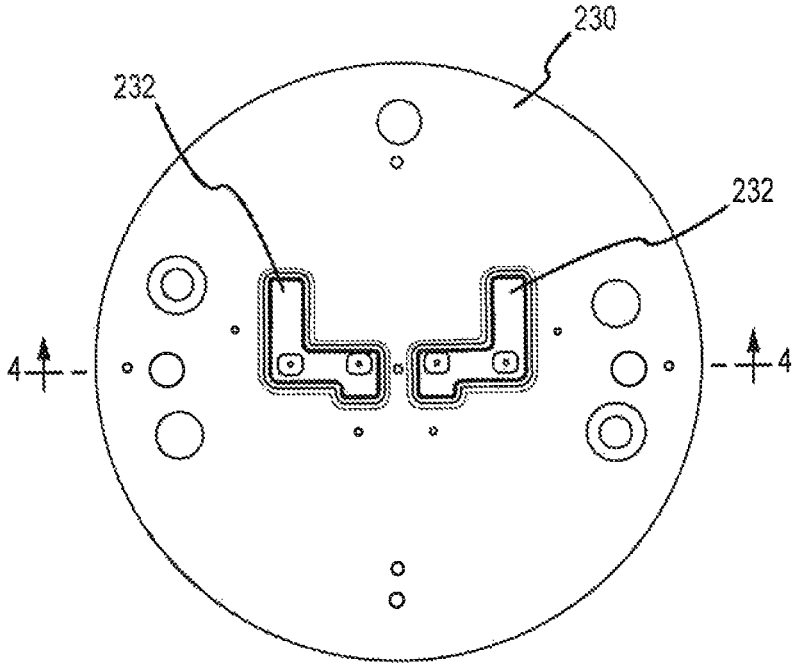
FIG. 3 is an end view of the die of FIG. 2.

Referring now to FIGS. 2, 5 and 6, the supply element 220 may include one or more ports 228 for receiving a metal to be extruded, one or more apertures 214 for receiving the mandrel (s) 222, one or more slots 229 for receiving the cassette 212 (FIGS. 4 and 7), and various other holes and/or pins for facilitating interconnection of the supply element 220 with the die cap 230 and/or sealing element 210. The ports 228 may be in communication with one or more bores 232 of the die cap (e.g., via the welding zone 250). The apertures 214 may be in communication with the middle zone 254 of the welding zone 250 (e.g., via mandrel(s) 222). The apertures 214 may be adapted to receive the mandrel(s) 222. In one embodiment, the apertures 214 are sized to restrictively engage an outer surface of the mandrel(s) 222.

Figure 7:
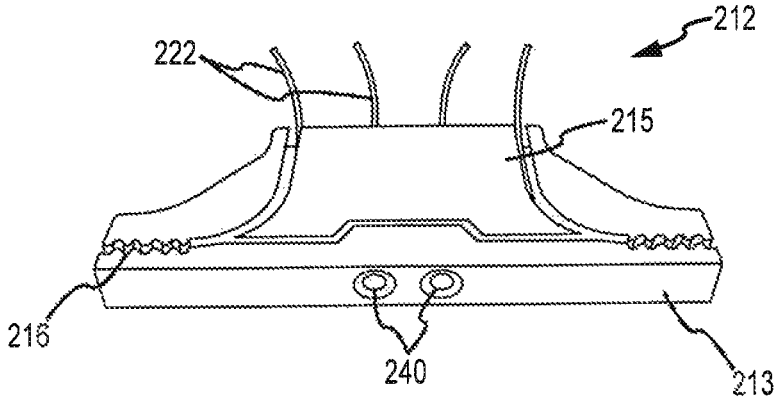
FIG. 7 is a top perspective view of a cassette of the die of FIG. 2.

Referring now to FIGS. 6 and 7, the cassette 212, which in the illustrated embodiment is utilized to hold the mandrel(s) 222, may include a cassette plate 215, a cassette tray 213, and teeth 216. Locking elements 240 (e.g., screws or other suitable apparatus) may be utilized to interconnect the various parts of the cassette 212. The teeth 216 may be utilized to fixedly hold the mandrel(s) 222 in place. The cassette 212 may fit into the slot 229 of the supply element 220. The mandrel(s) 222 may extend through the die assembly 200 (FIG. 2) via the apertures 214 of the supply element 220. The cassette 212 may be fixedly interconnected to the supply element 220 via the sealing element 210, which may be fixedly interconnected to the die cap 230 via locking elements 240.

Figure 8:
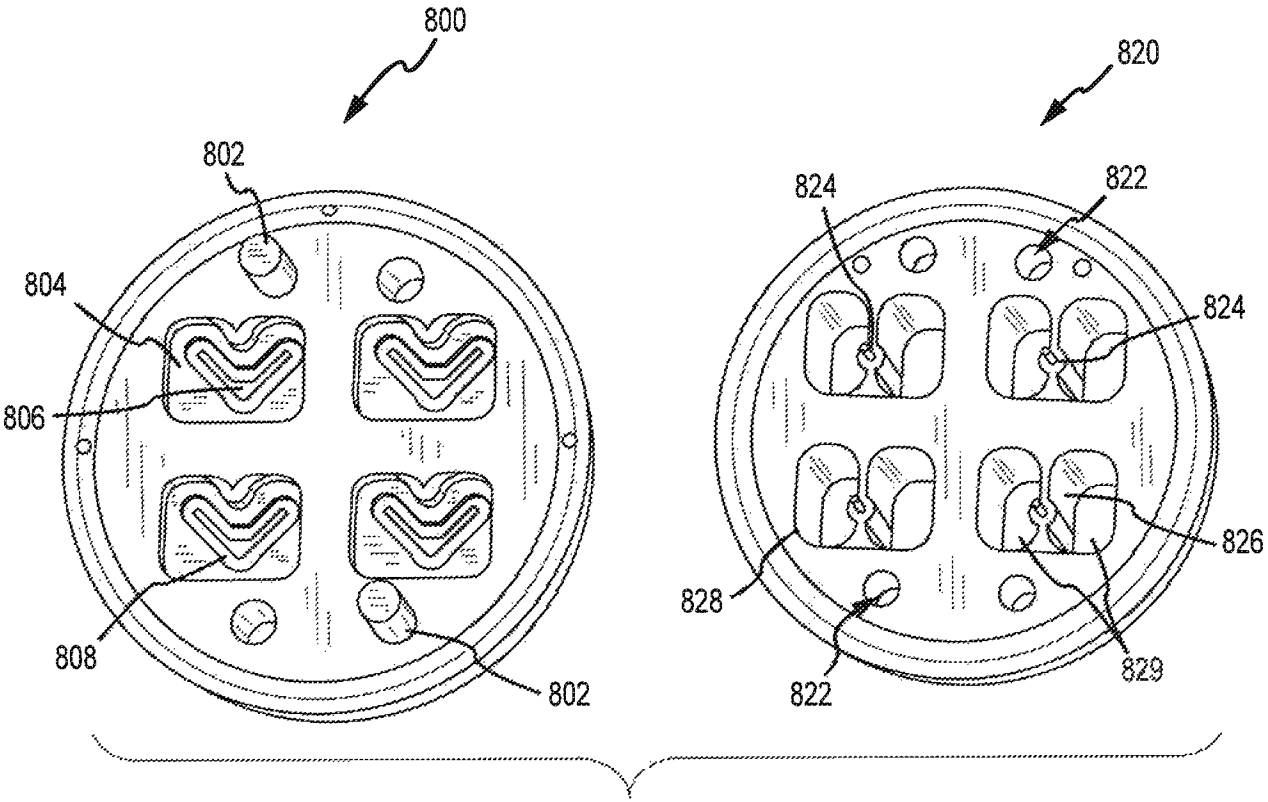
FIG. 8 is a perspective view of an embodiment of pieces of a die.
Figure 9:
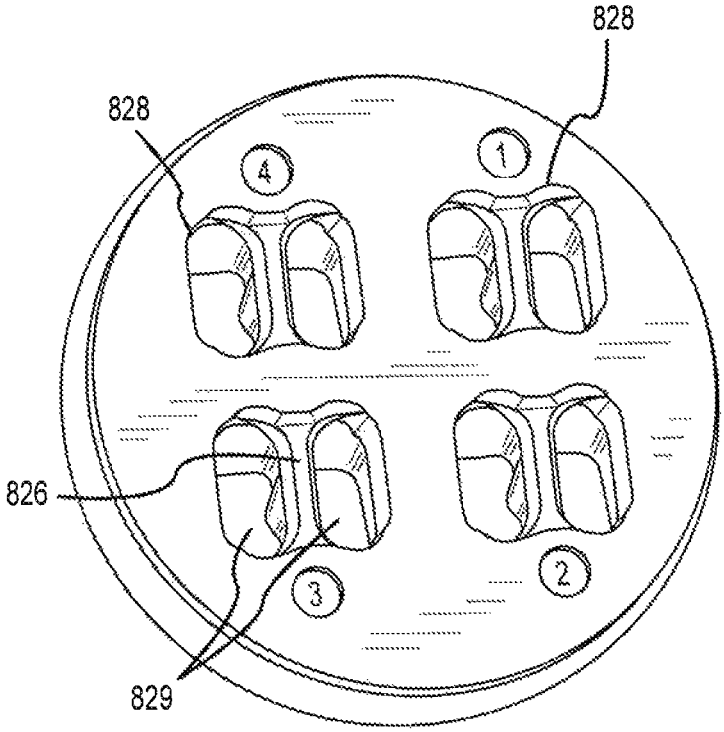
FIG. 9 is a perspective view of the metal entry side of the bridge plate of FIG. 8.

Another example of a die useful in producing metal bodies having one or more continuous microcavities is illustrated in FIGS. 8 and 9. In the illustrated embodiment, a die plate 800 and a bridge plate 820 may be utilized to form a die. This die may be utilized in a direct or indirect extrusion apparatus.

The die plate 800 includes pins 802 for mating with holes 822 of the bridge plate 820. The die plate 800 also includes at least one bore 804. The bore 804 includes a die opening 806 and a pocket 808 containing at least a portion of the die opening 806. The die opening 806 may be adapted to communicate with metal and/or at least a portion of one or more mandrels 824 of the bridge plate 820. The die opening 806 is generally shaped and sized to match the desired configuration of the extruded metal body. The pocket 808 generally is shaped and sized coincidental to the shape and size of the die opening 806 to further facilitate production of the extruded metal body.

The bridge plate 820 includes the above-referenced pin holes 822 and mandrels 824. The bridge plate also includes a plurality of main ports 828, separated into smaller ports (portholes) 829 via web 826. The main ports 828 of the bridge plate 820 in combination with the bore 804 may at least partially define a tortuous passageway for passage of metal.

The main ports 828 of the bridge plate 820 are adapted to receive a metal (e.g., a softened aluminum alloy billet, such as a billet made from a hard aluminum alloy) and allow passage of the metal therethrough via the smaller ports 829. The web 826 is adapted to separate the metal of each main port 828 into at least two sections. As the metal passes through the smaller ports 829 and out the main ports 828 and into the die opening 806 of the die plate, and further out of the pocket 808 of the bore 804, a metal body having the shape of the die opening 806 will be formed. Concomitant thereto, as the viscous metal flows through main ports 828 and/or bores 804, the metal may flow around and in contact with a portion of one of the mandrels 824. As the metal flows out of the die assembly via the die opening 806, the mandrel at least partially assists in creating an annular space within the metal by not allowing metal in those portions to fill those regions occupied by the mandrel. As the metal cools and exits the die, microcavities may be formed from the annular spaces that were produced from the mandrel.

As illustrated, the mandrels 824 are integral with the bridge plate (e.g., via the web 826). In other embodiments, one or more mandrels may be non-integral with the die plate and may be removable components. For example, the web 826 may include one or more complementary feature (e.g., female threads) adapted to receive and engage one or more complementary features of a mandrel 824 (e.g., male threads). In this embodiment, the mandrels 824 may be a removable mandrel that can be readily engaged with and disengaged from the bridge plate of the mandrel.

Figure 10:
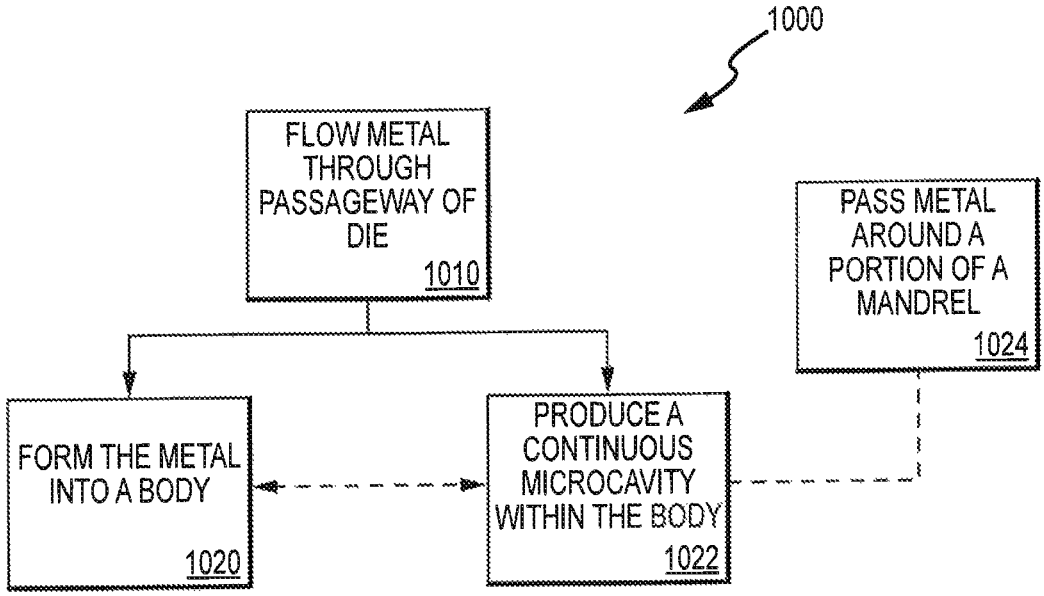
FIG. 10 is a flow chart illustrating one embodiment of a method for producing a metal body having a continuous microcavity.

Methods of making metal bodies having continuous microcavities are also provided. One embodiment of a method is illustrated in FIG. 10. In this embodiment, the method (1000) includes flowing a metal through a passageway of a die (1010), forming the metal into a body (1020), and producing, concomitant to the forming step (1020), a continuous microcavity within the body (1022). The flowing step (1010) may include pretreating the metal to be extruded (e.g., heating a metal billet to an appropriate extrusion temperature, such as at least about 300° C. or about 375° C., and up to about 500° C. or about 550° C.). The flowing step (1010) may include applying force to the metal so as to push the metal through the die, such as through a tortuous passageway of the die. The tortuous passageway may include an entrance zone, an exit zone, and a middle zone disposed between the entrance zone and the exit zone. The forming the metal into a body step (1020) may include passing the metal through the tortuous passageway, where the body is formed proximal the exit zone. The producing a continuous microcavity step (1022) may include passing the metal around at least a portion of a mandrel disposed within the middle zone of the tortuous passageway (1024). In one embodiment, the length of the mandrel is long enough so as to facilitate production of the continuous microcavities of the metal body, but not so long as to be damaged and/or removed from the die due to the forces applied to accomplish the flowing step (1010).

The method (1000) may include the step of moving the metal away from the mandrel and into the exit zone, thereby creating an annular space within the metal. In a related embodiment, the method (1000) may include the step of cooling the metal concomitant to the moving the metal step, thereby fixing the annular space, where, after the flowing step (1010), the annular space defines the continuous microcavity. In one embodiment, the metal body having the continuous microcavity comprises a diameter of not greater than about 2 mm. In one embodiment, the ratio of the diameter of the microcavity to the cross-sectional area of the metal body surrounding the microcavity is less than 1.

EXAMPLES

Example 1

A die assembly similar to FIG. 2 is produced. Metal is extruded via a direct extrusion, similar to that described above. Both flat and non-linear profiles are created. Continuous microcavities are produced in the metal bodies, and the microcavities have a diameter similar to that of the diameter of the mandrels. An x-ray tomographic analysis of the produced metal bodies reveals that the microcavities are continuous, straight and have smooth wall surfaces. Continuity of the microcavities is also demonstrated by shining a laser through the microcavities.

Example 2

Figure 11:
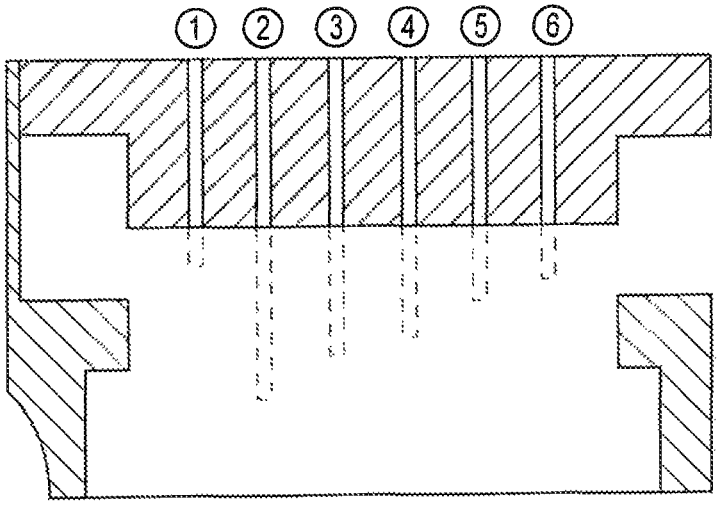
FIG. 11 is a schematic, cross-sectional view of one embodiment of a test die having mandrels of varying length.

Mandrels of various lengths are fixedly interconnected to a die similar to that of FIG. 2. The configuration of the mandrels is illustrated in FIG. 11. The mandrels extend from about 10 mm (Mandrel 1) to about 20 mm (Mandrel 2) into the welding zone of the die. A 2XXX series alloy is extruded via direct extrusion through the die. The extrusion press is a 10 MN press. The container liner diameter is about 146 mm. The mandrels have a diameter of about 5 mm. The total press ratio is about 59:1. The press ratio after feeding is about 6:1. The welding chamber has a height of about 10 mm after feeding. The length of the bearing surface is about 8 mm. The ram speed is about 1 mm/second. The billet temperature is about 550° C. The container liner temperature is about 450° C. The tool temperature is about 380° C.

Mandrels 1 and 2 fail to produce a continuous microcavity in an extruded metal body, whereas mandrels 3, 4, 5 and 6 produce continuous microcavities in the metal body. Mandrel 1 may fail since it is too short and does not extend far enough in the welding zone of the die. Mandrel 2 may fail as it is too long and is severed by the extruding metal during the extrusion process. Mandrels 3-6 extend at least partially into the middle zone of the welding zone (unlike Mandrel 1), but do not extend into the exit zone of the welding zone (unlike Mandrel 2) and thus are able to at least partially assist in producing continuous microcavities in the extruded metal body.

Example 3

A die assembly similar to that of FIGS. 8 and 9 is produced. Aluminum Association alloy 2099 is extruded through the die. Metal bodies similar to those of FIGS. 1E and 1G are produced. Continuous microcavities are produced in the metal bodies, and the microcavities have a diameter similar to that of the diameter of the mandrels. An x-ray tomographic analysis of the produced metal bodies reveals that the microcavities are continuous, straight and have smooth wall surfaces. Continuity of the microcavities is also demonstrated by shining a laser through the microcavity.

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. A method comprising:

(a) assembling an aerospace vehicle having an extruded aerospace structural component;

(i) wherein the extruded aerospace structural component is made from a hard aluminum alloy having a tensile yield strength of at least 50 ksi and comprises at least one continuous microcavity; and (b) after the assembling step (a), monitoring structural health of the extruded aerospace structural component via the at least one continuous microcavity of the extruded aerospace structural component.

2. The method of claim 1, wherein a ratio of a cross-sectional area of the continuous microcavity ($A_v$) to a cross-sectional area of the extruded aerospace structured component ($A_B$) is not greater than 10 ($A_v/A_B \leq 10$).

3. The method of claim 2, wherein the ratio of the cross-sectional area of the continuous microcavity to the cross-sectional area of the extruded aerospace structural component is not greater than 0.1 ($A_v/A_B \leq 0.1$).

4. The method of claim 3, wherein the continuous microcavity comprises a diameter of not greater than 2 mm.

5. The method of claim 4, wherein the extruded aerospace structural component is one of a fuselage stringer, a fuselage frame, and a wing stringer.

6. The method of claim 3, wherein the continuous microcavity comprises a diameter of not greater than 1.5 mm.

7. The method of claim 3, wherein the continuous microcavity comprises a diameter of not greater than 0.5 mm.

8. The method of claim 2, wherein the ratio of the cross-sectional area of the continuous microcavity to the cross-sectional area of the extruded aerospace structural component is not greater than 1 ($A_v/A_B \leq 1$).

9. The method of claim 1, wherein the extruded aerospace structural component is one of a fuselage stringer, a fuselage frame, and a wing stringer.

10. The method of claim 1, wherein the monitoring comprises applying vacuum or positive gas pressure to the continuous microcavity.

* * * * *